US006126345A

United States Patent [19]

Ito et al.

[11] Patent Number: 6,126,345

[45] Date of Patent: Oct. 3, 2000

[54] SHEET FEEDING DEVICE AND CORRECTION METHOD OF SHEET FEED AMOUNT IN THE SHEET FEEDING DEVICE

[75] Inventors: Noritsugu Ito, Tokoname; Hiroshi Igarashi, Nagoya; Shinji Kimura, Kani; Tsuyoshi Kushida, Iwakura, all of Japan

[73] Assignee: Brother Kogyo Kabushiki Kaisha, Nagoya, Japan

[21] Appl. No.: 09/122,624

[22] Filed: Jul. 27, 1998

[30] Foreign Application Priority Data

Jul. 29, 1997 [JP] Japan ..... 9-202716

[51] Int. Cl.[7] ..... B41J 11/42

[52] U.S. Cl. ..... 400/624; 400/283; 400/74

[58] Field of Search ..... 364/479.01; 271/265.01, 271/265.02, 265.03, 258.01, 259; 400/624, 283, 74; 347/19

[56] References Cited

U.S. PATENT DOCUMENTS 4,780,012 10/1988 Kikuchi et al. ..... 400/582
5,189,521 2/1993 Ohtsubo et al. ..... 358/296
5,484,141 1/1996 Yamashita et al. ..... 271/227
5,529,414 6/1996 Katano et al. ..... 400/636.2
5,555,462 9/1996 Fukumoto et al. ..... 347/218
5,610,639 3/1997 Takada et al. ..... 347/19
5,674,019 10/1997 Munakata et al. ..... 400/703

*Primary Examiner*—John S. Hilten
*Assistant Examiner*—Daniel J. Colilla
*Attorney, Agent, or Firm*—Oliff & Berridge, PLC

[57] ABSTRACT

A sheet feeding device has a correction value storage memory which stores a plurality of correction values for the previously set sheet feed error of the sheet feeding mechanism. The drive-control section operates to control the sheet feed amount by one correction value which allows the feed error of the sheet feeding mechanism to be minimized, the value being selected from the correction values stored in the correction value storage memory. In such the manner, the sheet feed amount is corrected by the correction value, so that the feed error of each component of the sheet feeding mechanism can be easily corrected.

19 Claims, 7 Drawing Sheets

| LINE | SHEET FEED AMOUNT (PULSE) | CORRECTION VALUE COLUMNS |
|---|---|---|
| 1 | 100 | −1 |
| 2 | 100 | −1 |
| 3 | 100 | −1 |
| 4 | 100 | −1 |
| 5 | 100 | −1 |
| 6 | 100 | −1 |

FIG.3

| SHEET FEED AMOUNT (PULSE) | CORRECTION VALUE COLUMNS | | | | | | | | | | | | | | |
|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 |
| 1～50 | 0 | 0 | 0 | 0 | 0 | 0 | 0 | 0 | 0 | 0 | 0 | 0 | 0 | 0 | 0 |
| 51～150 | −1 | −1 | −1 | −1 | 0 | 0 | 0 | 0 | 0 | 0 | 0 | 1 | 1 | 1 | 1 |
| 151～250 | −2 | −2 | −1 | −1 | −1 | −1 | 0 | 0 | 0 | 1 | 1 | 1 | 1 | 2 | 2 |
| 251～350 | −3 | −2 | −2 | −2 | −1 | −1 | 0 | 0 | 0 | 1 | 1 | 2 | 2 | 2 | 3 |
| 351～450 | −4 | −3 | −3 | −2 | −2 | −1 | −1 | 0 | 1 | 1 | 2 | 2 | 3 | 3 | 4 |
| 451～550 | −5 | −4 | −3 | −3 | −2 | −1 | −1 | 0 | 1 | 1 | 2 | 3 | 3 | 4 | 5 |
| 551～650 | −6 | −5 | −4 | −3 | −2 | −2 | −1 | 0 | 1 | 2 | 2 | 3 | 4 | 5 | 6 |
| 651～740 | −7 | −6 | −5 | −4 | −3 | −2 | −1 | 0 | 1 | 2 | 3 | 4 | 5 | 6 | 7 |
| 741～ | −7 | −6 | −5 | −4 | −3 | −2 | −1 | 0 | 1 | 2 | 3 | 4 | 5 | 6 | 7 |

FIG.7

| CORRECTION ERROR LEVEL | 1 | 2 | 3 | 4 | 5 | 6 | 7 | 8 |
|---|---|---|---|---|---|---|---|---|
| CORRECTION VALUE (%) | −1.5 | −1.0 | −0.5 | −0 | 0.5 | 1.0 | 1.5 | 2.0 |

SHEET FEEDING DEVICE AND CORRECTION METHOD OF SHEET FEED AMOUNT IN THE SHEET FEEDING DEVICE

BACKGROUND OF THE INVENTION

1. Field of the Invention

The present invention relates to a sheet feeding device, and more particularly to a sheet feeding device which feeds sheets such as recording paper and the like and which is incorporated in a printing apparatus such as a printer.

2. Description of Related Art

Heretofore, a printing apparatus such as a printer incorporates a sheet feeding device which sequentially feeds sheets in synchronization with a printing operation of a print head on the sheets.

This type of sheet feeding device consists of a feed roller for feeding sheets and a pulse motor which drives the feed roller. The device is arranged so that a CPU serving as a drive-controller sends the predetermined number of pulses to the pulse motor to feed a sheet at a predetermined feed amount.

At this time, the exact sheet feed is needed for an appropriate printing on the sheet. However, even if the pulses corresponding to the predetermined feed amount are transmitted from the CPU to the pulse motor, it is actually difficult to exactly feed the sheet at a desired feed amount due to variations in roller diameter and the like.

For measures against feed failure resulting from the variations in roller diameter and the like, the roller diameter is controlled as held to closer tolerances or an angle of attachment of a print head is adjusted, whereas such the control and adjustment are complicated procedures, causing an increased cost.

SUMMARY OF THE INVENTION

The present invention has been made in view of the above circumstances and has an object to overcome the above problems and to provide a sheet feeding device whereby sheets can accurately be fed at a desired feed amount without needing the control to hold roller diameter to closer tolerances or the adjustment of an angle of attachment of a print head.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, there is provided a sheet feeding device comprising a sheet feeding mechanism for feeding sheets and a drive-controller for drive-controlling the sheet feeding mechanism, the sheet feeding device further comprising correction value storage memory which stores a plurality of correction values in correspondence with various sheet feed amounts each of which is previously set, the correction values being to be used for correcting various sheet feed errors of the sheet feeding mechanism, wherein the drive-controller selects a correction value, which minimizes the sheet feed error of the sheet feeding mechanism, from among the correction values stored in the correction value storage memory, and corrects the sheet feed amount in the sheet feeding mechanism based on the selected correction value.

According to the above structure, the correction value storage memory stores a plurality of correction values used to correct the feed error of the sheet feed mechanism and one correction value that minimizes the feed error is selected from the plural correction values. The sheet feed amount is corrected by the selected correction value so that the sheet is fed at the corrected feed amount. Accordingly, an exact and reliable sheet feed can be achieved without controlling the feed precision of the sheet feed mechanism.

According to the second aspect of the present invention, there is provided a sheet feeding device comprising a sheet feeding mechanism for feeding sheets and a drive-controller for drive-controlling the sheet feeding mechanism, the sheet feeding device further comprising a correction table which stores correction error levels obtained by dividing a sheet feed error generated in a sheet feed into plural levels and correction factors set in correspondence with each of the correction error level, which are used for correcting the sheet feed error of the sheet feeding mechanism, wherein the drive-controller calculates an amount of correction to a predetermined sheet feed amount by adding the predetermined sheet feed amount to an amount calculated by multiplying a correction factor corresponding to a correction error level in the correction table to the predetermined sheet feed amount, and corrects the sheet feed amount in the sheet feeding mechanism based on the calculated amount of correction.

In the above device, the correction amount with respect to the predetermined sheet feed amount is calculated in the manner that the predetermined sheet feed amount multiplied by the correction factor which corresponds to the error level in the correction table is added to the predetermined sheet feed amount. Then, the sheet feeding device feeds a sheet at the sheet feed amount corrected based on the calculated correction amount. Accordingly, regardless of the level or extent of the feed error, the sheet feeding device can easily correct the sheet feed amount at which a sheet can be exactly fed.

According to third aspect of the present invention, there is provided a correction method of sheet feed amount in a sheet feeding device comprising a sheet feeding mechanism and a drive-controller for drive-controlling the sheet feeding mechanism, the correction method comprising the steps of storing a plurality of correction values corresponding to various sheet feed amounts in a correction value storage memory, the correction values being used for correcting sheet feed errors of the sheet feeding mechanism, selecting a correction value which minimizes the sheet feed error of the sheet feeding mechanism from among the correction values stored in the correction value storage memory, and correcting the sheet feed amount in the sheet feeding mechanism based on the selected correction value.

In the above method, a correction value which allows the feed error to be minimized is selected from among the plurality of correction values stored in the correction value memory and the sheet feed amount is corrected based on the selected correction value so that the sheet is fed at the corrected feed amount. Accordingly, the feed error of the sheet feeding device can be easily corrected, thus achieving an exact and reliable sheet feed without tight control of feeding precision of the sheet feeding mechanism.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

FIG. 3 is an example of a table of correction value columns;

FIG. 7 is an example of a table in which correction values for the feed error are set according to the levels of the feed error.

DETAILED DESCRIPTION OF THE PREFERRED EMBODIMENTS

A detailed description of one preferred embodiment of a sheet feeding device embodying the present invention will now be given referring to the accompanying drawings.

Figure 1:
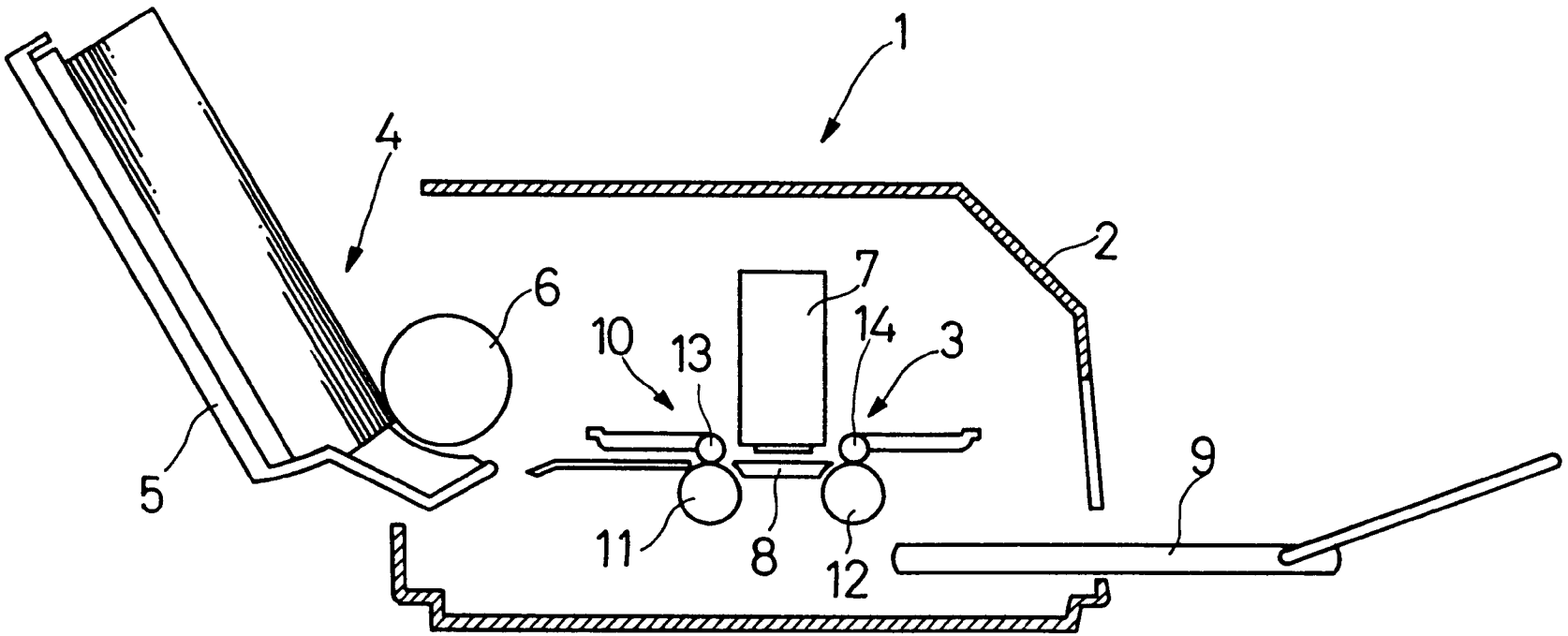
FIG. 1 is a side view of main components of a printing apparatus incorporating a sheet feeding device in an embodiment according to the present invention.

FIG. 1 is a side view of main components of a printing apparatus incorporating a sheet feeding device in an embodiment according to the present invention.

In FIG. 1, the printing apparatus 1 has a casing 2, a print unit 3, and a sheet supply mechanism 4 disposed in the rear side of the casing 2 to supply sheets such as printing paper to the print unit 3. The sheet supply mechanism 4 consists of a supply tray 5 which accommodates therein a stack of sheets and a supply roller 6 disposed at a lower end side of the tray 5. The sheets set in the supply tray 5 are picked up by the roller 6 one by one to be supplied to the print unit 3.

The print unit 3 is provided with a print head 7 which prints images on a sheet and a platen 8 which supports the sheet. The print head 7 is mounted on a carriage not shown and is designed so as to perform one printing per scan by the drive of a carriage motor 19 (see FIG. 2) which operates to move the carriage. With the repetition of the printing operation, all printing data are printed on the sheet. The so printed sheet in the print unit 3 is discharged onto an output tray 9.

In the present embodiment, a sheet feeding device is incorporated in the print unit 3 of the printing apparatus 1. The sheet feeding device has a sheet feeding mechanism 10 for feeding sheets and a CPU 23 (see FIG. 2) serving as a drive-controller which controls the sheet feeding mechanism 10 to feed sheets at a predetermined feed amount.

The sheet feeding mechanism 10 consists of a feed roller 11 and an output roller 12. The feed roller 11 is disposed on an upstream side of the platen 8 and operates to transfer a sheet. The output roller 12 is disposed on a downstream side of the platen 8 and is driven in synchronization of the feed roller 11 to cause the discharge of the sheet. Those feed roller 11 and output roller 12 are connected via a gear train not shown to a pulse motor 15 (see FIG. 2) serving as a power source.

A nip roller 13 which is rotated by the rotation of the feed roller 11 is arranged opposite to the feed roller 11 through a sheet. Another nip roller 14 which is rotated by the rotation of the output roller 12 is arranged opposite to the output roller 12.

Figure 2:
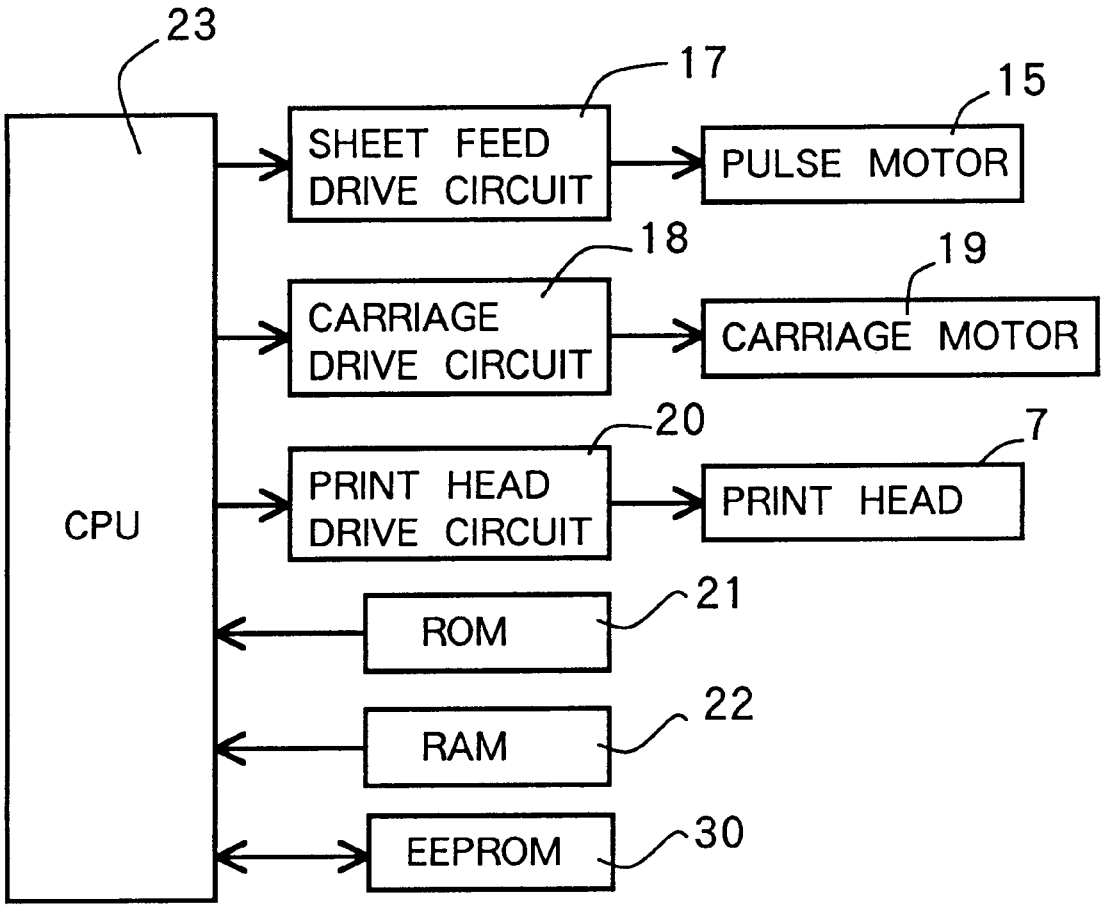
FIG. 2 is a block diagram of a control system of the printing apparatus in FIG. 1.

In FIG. 2, the CPU 23 is connected to a sheet feed driving circuit 17 which drives the pulse motor 15, a carriage driving circuit 18 which drives the carriage motor 19, a print head driving circuit 20 which drives the print head 7, a ROM 21, a RAM 22, and an EEPROM (electrically erasable programmable ROM) 24. The ROM 21 stores a control head program for controlling the drive circuits 17, 18, and 20 to drive in accordance with produced print data, a test print program for selecting an optimum correction value column which will be mentioned later, and a correction program for correcting the sheet feed amount by each correction value in the selected column. The RAM 22 stores correction values used for correcting the sheet feed amount in the form of a table of correction value columns, serving as correction value storage memory. In the RAM 22, set are various memories, buffers, and a work-area for provisional storage of the correction program when executed. The EEPROM 24 stores data indicating which column a selected correction value column is located, e.g., the number of the column.

The correction values stored in the ROM 21 are used to correct the sheet feed error caused by variations in roller diameter of the sheet feeding mechanism 10, especially, the feed rollers 11 and 12. The correction values are set on a column-by-column basis in the correction value column table in accordance with the previously determined feed error.

FIG. 3 shows an example of a table of the correction value columns. In FIG. 3, the correction values are stored in the ROM 21 in the form of a look-up table of the numbers of pulses to be corrected that are obtained by classifying in advance the numbers of pulses corresponding to the sheet feed amount into plural sections, multiplying a correction factor for a proper sheet feed amount to the number of pulses on a section-by-section basis, and applying an appropriate process to (e.g., rounding off) the fraction that is less than 1 pulse.

In this manner, the sheet feed amount and each correction value can be specified by the number of pulses, the corrected sheet feed amount can be provided to the pulse motor 15 in the as-unchanged form of the number of pulses, and therefore the control of the sheet feed can be simplified. In this case, a minimum unit of the sheet feed amount is specified by a particular number of pulses at which the pulse motor 15 is driven. More specifically, the minimum unit of sheet, namely, 1/600-inch sheet is fed by 3 pulses so that a resolution of 600 dpi (dot per inch) can be obtained in a direction of sheet feed. Since this causes a minimum feed unit to be specified by a particular number of pulses, the sheet feed amount and an amount of correction can be easily determined from the number of pulses, and thus a simple constitution can ensure that the control is accomplished. In this case, a particular number of pulses, that is, the number of pulses corresponding to the minimum feed unit can be set as large as possible, whereby the more exact correction can be performed.

Also referring to FIG. 3, a correction value column table has a plurality of correction value columns in which correction values are stored, each value being set so as to correspond to a different sheet feed amount. The correction value columns are generally classified into the following columns: a reference column (a column 7 shown in FIG. 3) in which the correction values are set to 0 regardless of the sheet feed amount; a plurality of negative side columns (columns 0 through 6 shown in FIG. 3) in which the correction values are set so that the actual sheet feed may be reduced as the sheet feed amount is increased; and a plurality of positive side columns (columns 8 through 14 shown in FIG. 3) in which the correction values are set so that the actual sheet feed may be increased as the sheet feed amount is increased. Furthermore, as the negative and positive side columns, a plurality of columns are prepared in response to such an extent or level that a feed error of feed rollers 11 and 12 to the sheet feed amount is reduced or increased. That is, when the positive side columns are taken as an example, six columns, the columns 8 through 14, are prepared as the positive side columns. For example, when the sheet feed amount is 651–740 pulses, 1 pulse is stored in the column 8, the correction value is increased as a column number gets higher in sequence, and then 7 pulses are stored in the column 14. Accordingly, when the feed error of the feed rollers 11 and 12 is considerably small, namely, when the actual sheet feed is considerably smaller than the sheet feed amount, the correction value column adaptable to this case is the column near the column 14, for example. On the other hand, when the actual sheet feed is not so smaller than the sheet feed amount, the correction value column adaptable to this case is the column near the column 8, for example. In this way, a plurality of negative and positive side columns are prepared in response to such an extent that the feed error is reduced or increased, whereby the more delicate correction can be achieved and thus the precision of the sheet feed can be more improved.

One correction value column allowing the feed error of this sheet feed mechanism 10 to be minimized is selected from the correction value column table stored in ROM 21. The selected correction value column number is then stored in EEPROM 24. In CPU 23, the sheet feed amount is corrected in accordance with each correction value in this one selected correction value column.

Figure 4:
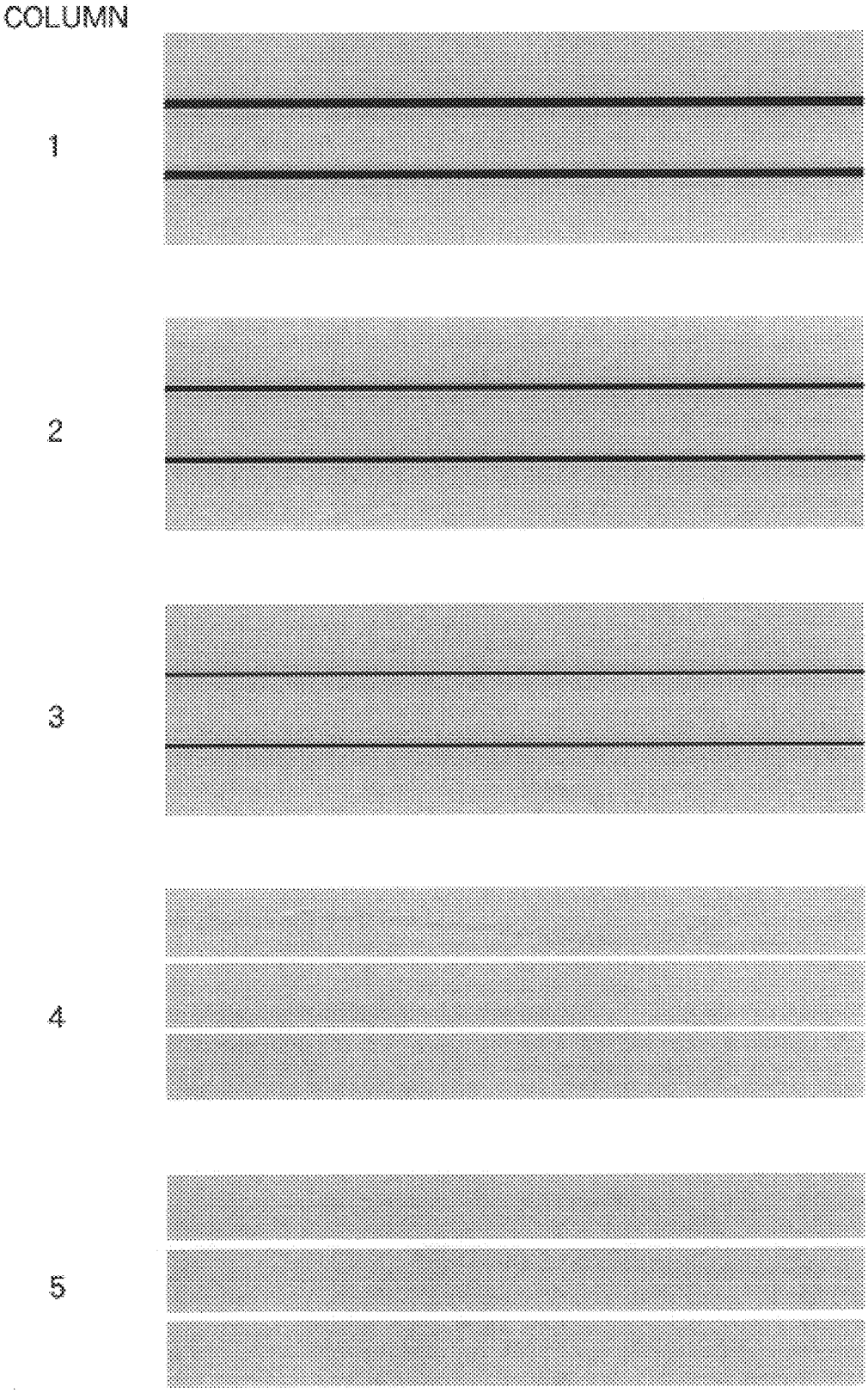
FIG. 4 is an explanatory view of an example of adjustment patterns which are printed in accordance with test print program.

Next, referring to FIG. 4, explanation is made on a method for selecting one correction value column allowing the feed error of the sheet feed mechanism 10 to be minimized.

In this method, at first, the test print program set in the ROM 21 is executed. In accordance with this test print program, adjustment patterns for correction value columns as shown in FIG. 4 are printed. It is to be noted that the adjustment patterns shown in FIG. 4 are printed with more definite difference among columns than the actual adjustment patterns for well understanding of the description. These patterns are made by solid printing executed on several lines (three lines in FIG. 4) at a specific sheet feed amount. When the print density is set in advance to a lighter setting (e.g., a density of 50%), an overlapped portion of lines is viewed as a black stripe, while a clearance portion between lines is viewed as a white stripe. For example, it is apparent from FIG. 4 that, since black stripes are viewed in the columns 1 and 2, indicating the overlap of lines, the actual sheet feed is too small than the sheet feed amount corrected by the correction value column 1 or 2, and on the other hand, since while stripes are viewed in the columns 4 and 5, indicating the clearance between lines, the actual sheet feed amount is too large than the sheet feed amount corrected by the correction value column 4 or 5. It is clear from such the observation of the adjustment patterns that the column for the pattern printed so that line-space is neither too small nor too large, namely, the column 3 allows a feed error of the concerned sheet feeding mechanism 10 to be minimized. Thus, the column 3 is selected.

Such the selection of a correction value column is performed in a manufacturing process so that the optimum correction value column is selected for every device and its number of the selected column is stored in the EEPROM 24. Alternatively, the sheet feeding device may be arranged so that an user may adjust as appropriate the optimum correction value column, not only in the manufacturing process. FIG. 4 shows the adjustment patterns printed corresponding to the columns 1 through 5; however, in the case of the correction value column table shown in FIG. 3, the test print is performed for all of the columns 1 through 14. The selection manner of the optimum column from the correction value column table is not limited to the above manner. For example, it may be arranged so as to feed a sheet at a previously determined feed amount, measure a distance between a feed start point and feed termination point, and select the optimum column based on the measured value.

Figure 5:
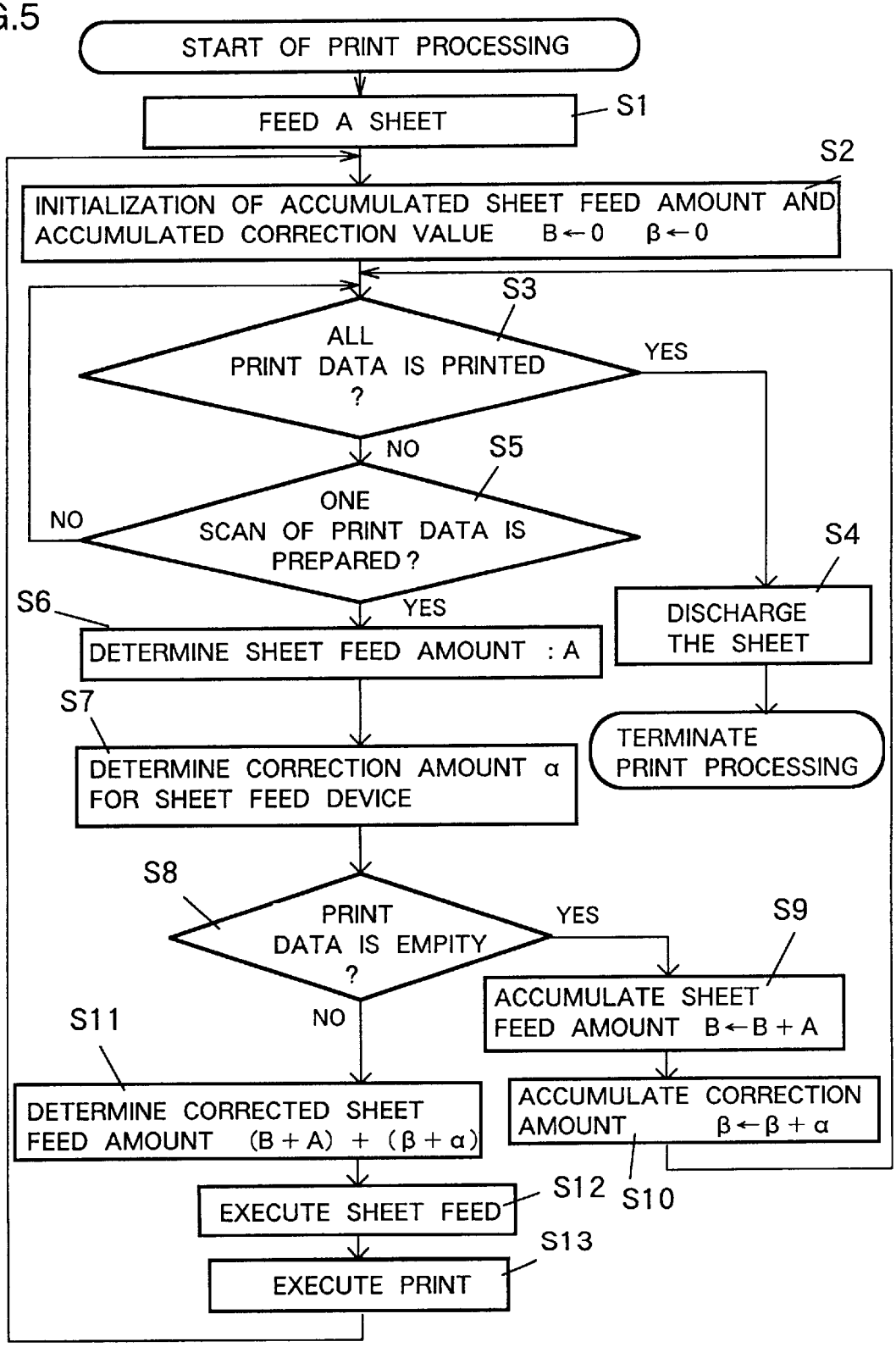
FIG. 5 is a flow chart of the control of print processing in a state where a certain correction value column is selected.

FIG. 5 is a flow chart to explain the control of print processing of print data in a state where a specific correction value column is selected. Referring to FIG. 5, a method for correcting the sheet feed amount by the use of the correction values of the selected correction value column will be described.

At first, as soon as a print operation is started, the sheet is fed into the print unit 3 by the sheet supply mechanism 4 (S1). At this time, when an accumulated sheet feed amount B and the accumulated correction value $\beta$ are detected, an initialization is executed, namely, the accumulated sheet feed amount and correction value are set to 0 (S2). Next, it is judged whether or not all print data is printed (S3). If all the print data is not printed, it is judged whether or not one scan of print data is prepared in the CPU 23 (S5). If the print data is not prepared, this judgement is repeated until the print data is prepared. When the print data is prepared, a sheet feed amount A corresponding to one scan of print is determined (S6). Subsequently, an amount of correction $\alpha$ corresponding to the sheet feed amount is determined (S7). For this determination of the correction amount $\alpha$, the correction value for the sheet feed amount A is read from the correction value column table stored in the ROM 21 based on the number of the selected correction value column, the number being stored in the EEPROM 24. For instance, when the number of correction value column stored in the EEPROM is "3" and the sheet feed amount A is determined to 100 pulses, CPU 23 searches and retrieves a correction value corresponding to the 51 to 150 section of the sheet feed amount in the column 3. In the case of FIG. 3, the corresponding correction value is "−1", and therefore the amount of correction $\alpha$ is determined to −1 pulse.

Next, the judgement is made as to whether or not the print data is empty, that is, whether or not a blank line is inserted without printing in the subsequent scan (S8). When the print data is empty, that is, the print is not carried out in the subsequent scan, the sheet feed amount A and the correction amount $\alpha$ are accumulated (S9 and S10), and then the processing is returned to a step before the step (S3) of judging whether or not all the print data is printed. When the print data is not empty, a sheet feed amount required for the subsequent print is determined by adding the correction amount $\alpha$ (and the accumulated amount of correction $\beta$ if detected) to the sheet feed amount A (and the accumulated sheet feed amount B if detected) (S11), and the sheet feed is executed in accordance with the determined sheet feed amount (S12). The print head 7 is then scanned by driving the carriage motor 19 (see FIG. 2), and the print is executed (S13). After the print is terminated, the processing is again returned to the step before the step (S3) of judging whether or not all the print data is printed. This processing is repeated until all the print data is printed. Upon the completion of print of all the print data, the sheet is discharged from the print unit 3 (S4), and then the print processing is terminated. In such a manner, a predetermined print processing is achieved on the sheet.

Figure 6:
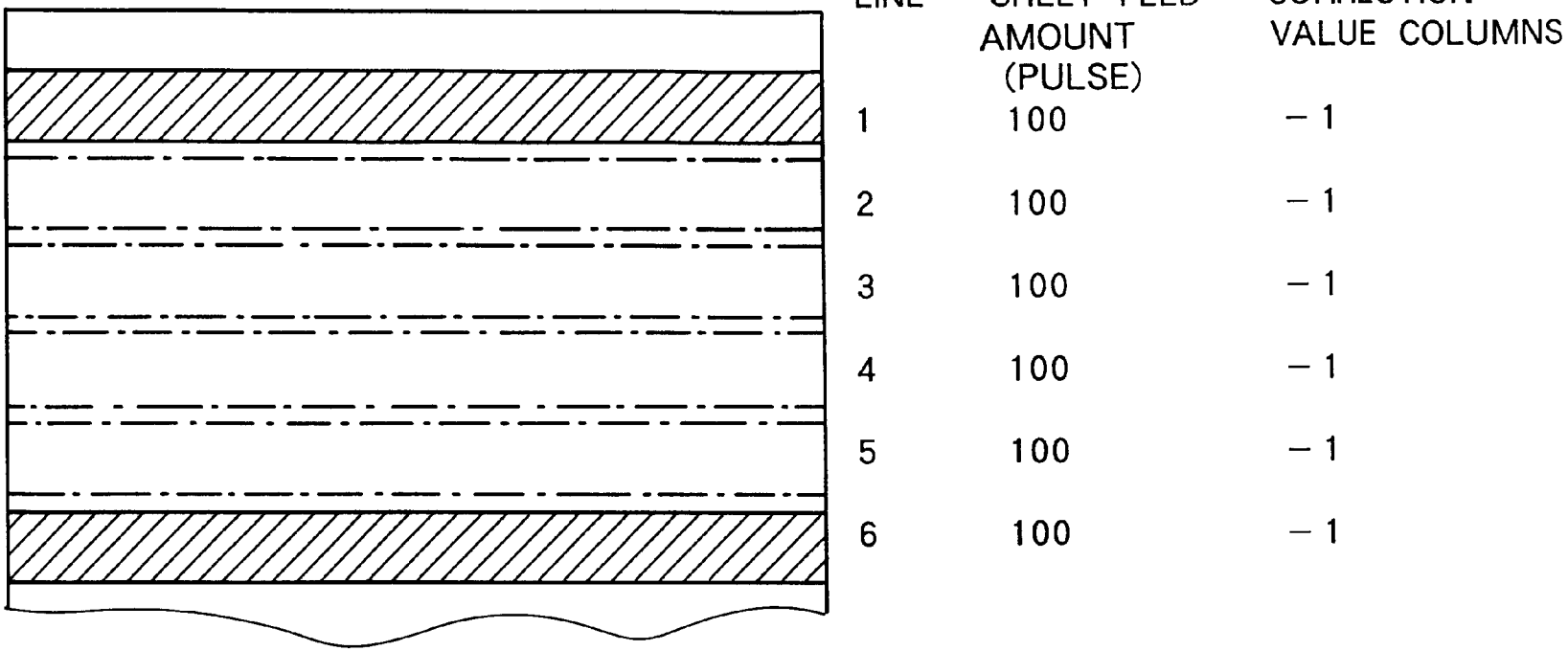
FIG. 6 is an explanatory view showing an embodied case that there is blank data in the flow chart of FIG. 5.

More specific description on the case that print data is empty is made below. In this description, for example, it is taken as an example as shown in FIG. 6 that when one scan of the sheet feed amount is 100 pulses (corresponding to the first number of the driving pulse) and the column 3 is selected, the correction value being "−1" (corresponding to the second number of the driving pulse) from the table of FIG. 3. In this case, when print data for the first and sixth lines is detected, after completion of the scan on the first line, the sheet feed amount is accumulated by 100 pulses per scan for the second through fifth lines, resulting in the accumulated sheet feed amount of 400 pulses, and similarly the correction amount is accumulated by −1 per scan, resulting in the accumulated correction amount of −4(−1×4 (accumulated number). For the scan on the sixth line, the accumulated sheet feed amount of 400 pulses is added to the sheet feed amount for the sixth line which is 100 pulses and the accumulated correction amount of −4 is added to the correction amount for the sixth line which is −1. Those added sheet feed amount and correction amount are summed up to determine the corrected sheet feed amount, which results in 495 pulses (corresponding to the third number of the driving pulse). The sheet feed is executed in accordance with the corrected sheet feed amount. In other words, the sheet feed amount and the correction value are determined for every one scan of a print processing and, if print data is empty, they are accumulated.

According to the above structure, regardless of variations in roller diameter and the like of the feed rollers 11 and 12, the sheet feed amount is corrected by each correction value of the correction value column selected from the correction value column so that a sheet is fed based on the corrected sheet feed amount. Accordingly, the feed error caused by the sheet feeding mechanism 10, especially, each roller diameter of the feed rollers 11 and 12 can be easily corrected. In this case, different sheet feed amounts can be corrected by the corresponding correction values stored in the plurality of columns, so that an exact sheet feed at a desired feed amount can be executed without the close control of the feed precision of the sheet feeding mechanism 10. Consequently, fine sheet feed can be achieved with an inexpensive cost and a simple structure, allowing the printing apparatus 1 incorporating the sheet feeding device to perform the proper print.

In the above case, furthermore, with the correction value column table including a reference column, a plurality of negative side columns and positive side columns, the sheet feed amount can be corrected as follows. For example, in the sheet feeding mechanism 10 having such the feed error that the actual sheet feed is a little smaller than the predetermined sheet feed amount, the actual sheet feed is gradually reduced as the sheet feed amount is increased. In such the case, the optimum correction value column including the correction values adaptable to the difference between the feed amount and the actual feed is selected from the positive side columns of the table. If the sheet feed amount is corrected by the correction values of the selected column, even though the actual sheet feed tends to decrease as the increase of the sheet feed amount, the feed amount is corrected by each correction value so that the actual feed is increased to correspond to the actually reduced amount of sheet feed. Thus, regardless of the sheet feed amount, an exact and reliable sheet feed at a predetermined feed amount can be executed.

On the other hand, in the sheet feeding mechanism 10 having the feed error between the actual sheet feed and the predetermined sheet feed amount so that the former is a little larger than the latter, the actual sheet feed is gradually increased as the sheet feed amount is increased. In this case, the optimum correction value column including the correction values adaptable to the difference between the feed amount and the actual sheet feed is selected from the negative side columns of the table. If the sheet feed amount is corrected by the correction values of the selected column, even though the actual sheet feed tends to increase as the increase of the sheet feed amount, the feed amount is corrected by each correction value so that the actual feed is decreased to correspond to the actually increased amount of sheet feed. Thus, regardless of the sheet feed amount, an exact and reliable sheet feed at a predetermined feed amount can be executed.

In the sheet feeding mechanism 10 which can execute an actual sheet feed corresponding to a predetermined sheet feed amount, namely, which has no feed error, if it is adapted such that the sheet feed amount is corrected by the reference column of the correction value column table, a sheet can be fed surely and correctly at the predetermined feed amount.

Consequently, any of the sheet feeding mechanisms 10, which has such the feed error that the actual sheet feed is a little smaller than the predetermined feed amount, which has such the feed error that the actual sheet feed is a little larger than the feed amount, or which has no feed error, can feed a sheet securely and exactly at a predetermined feed amount. The optimum correction column can be selected from the plural negative side columns or positive side columns in response to such an extent that the feed error is reduced or increased, resulting in an exact and sure sheet feed at a predetermined feed amount regardless of the extent of the feed error.

In the above embodiment, in the control of print processing, although the sheet feed amount and correction value are determined per one scan of print processing, and they are accumulated if print data is empty, only the sheet feed amount may be accumulated so that the correction value may be determined based on the accumulated sheet feed amount.

Although the correction value column table with the reference column, the negative side columns and positive side columns is prepared so that the optimum column is selected from the table to correct the sheet feed amount, the table shown in FIG. 7, for example, may be prepared, in which correction factors (correction values) to an appropriate sheet feed amount are set on a one-by-one basis in accordance with the level of the feed error. Alternatively, the correction program and the like may include the correction values without the preparation of the table. In other words, the EEPROM 24 stores in advance the correction error level corresponding to the proper correction factor allowing the feed error of the sheet feeding mechanism 10 to be minimized, and the amount of correction $\alpha$ for the sheet feed amount A corresponding to one scan of print is calculated by the following formula:

$$\alpha = A \times (1 + \text{Correction factor})$$

where if the fraction is less than 1 pulse, for example, an appropriate rounding is performed to calculate the number of pulses to be corrected. At this time, the fraction not employed for the actual sheet feed or the deficiency resulting from raising to a unit may be, of course, stored in the appropriate area in the RAM 22 in consideration of the determination of the subsequent amount of correction $\alpha$, for example.

It is to be noted that the sheet feeding device is described in the above embodiment using the printing apparatus 1 as one example, however, the present invention can be adapted to wide image forming apparatus such as a copy machine, a facsimile machine, and others.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet feeding device comprising a sheet feeding mechanism having a feed motor for feeding sheets and a drive-controller for drive-controlling the feed motor of the sheet feeding mechanism, the sheet feeding device further comprising:

correction value storage memory which stores a plurality of correction values for drive pulses applied to the feed motor in correspondence with various sheet feed amounts based on a number of drive pulses;

selecting means for selecting a correction value which minimizes the sheet feed error of the sheet feeding mechanism from among the correction values stored in the correction value storage memory, based upon a visual observation of a printed pattern as a result of printing execution;

wherein the drive-controller reads the correction value, which minimizes the sheet feed error of the sheet feeding mechanism, from among the correction values stored in the correction value storage memory, and corrects the sheet feed amount in the sheet feeding mechanism based on the selected correction value.

2. A sheet feeding device according to claim 1, wherein the correction value storage memory stores a plurality of correction value columns each having correction values for drive pulses applied to the feed motor corresponding to each of different sheet feeding amounts based on a number of drive pulses; and the selecting means selects a correction value column, which minimizes the sheet feed error of the sheet feeding mechanism, from among the correction value columns stored in the correction value storage memory, and the drive-controller corrects the sheet feed amount in the sheet feeding mechanism based on a correction value in the correction value column.

3. A sheet feeding device according to claim 2, wherein the correction value column stored in the correction value storage memory includes:

a correction value reference column in which the correction values are set to 0 regardless of the sheet feed amount;

a correction value negative side column in which the correction values are set so that, as the sheet feed amount is increased, an actual sheet feed amount in the sheet feeding mechanism is reduced; and a correction value positive side column in which the correction values are set so that, as the sheet feed amount is increased, an actual sheet feed amount in the sheet feeding mechanism is increased.

4. A sheet feeding device according to claim 3, wherein the sheet feeding mechanism comprises a plurality of rollers for feeding the sheet, and a pulse motor which is operated by drive pulses applied from the drive-controller and drives each of the rollers to rotate.

5. A sheet feeding device according to claim 4, wherein the correction values in each of the correction value column stored in the correction value storage memory and the sheet feed amount in the sheet feeding mechanism are determined by a number of the drive pulses to be applied to the pulse motor, and the drive-controller corrects the sheet feed amount based on the number of drive pulses.

6. A sheet feeding device according to claim 5, wherein a minimum unit of the sheet feed amount is specified by a particular number of pulses to be applied to the pulse motor.

7. A sheet feeding device according to claim 6, further comprising a print head which prints images on a sheet fed by the sheet feeding mechanism, and the particular number of drive pulses corresponding to the minimum unit of the sheet feed amount are determined so that images of a predetermined resolution is printed on the sheet along a sheet feed direction of the sheet feeding mechanism by the print head.

8. A sheet feeding device according to claim 5, wherein the correction values stored in the correction value storage memory are set based on the sheet feed error caused by variations in each diameter of the rollers.

9. A sheet feeding device according to claim 8, wherein the correction values stored in the correction value storage memory are determined by dividing the number of pulses corresponding to the sheet feed amount into plural sections and multiplying a predetermined correction factor to the number of pulses on a section-by-section basis.

10. A sheet feeding device according to claim 9, wherein the correction value negative column and the correction value positive column respectively consist of a plurality of columns.

11. A sheet feeding device according to claim 10, wherein in response to the sheet feed error caused by the variations in each diameter of the rollers being reduced or increased.

12. A sheet feeding device according to claim 5, further comprising a correction value column memory which stores information of the correction value column selected by the drive-controller, wherein the drive-controller selects a correction value column from among the correction value storage memory based on the information of the selected correction value column stored in the correction value column memory.

13. A sheet feeding device according to claim 12, wherein the information of the correction value column is a number specifying the selected correction value column.

14. A sheet feeding device according to clam 13, further comprising:

a print head which prints image on a sheet fed by the sheet feeding mechanism;

first calculation means for calculating a first number of drive pulses corresponding to a predetermined sheet feed amount needed for image printing by the print head;

means for reading a correction value column in the correction value storage memory in accordance with the number of the column stored in the correction value column memory and retrieving a second number of drive pulses corresponding to the first number of drive pulses in the read correction value column; and second calculation means for calculating a third number of drive pulses corresponding to a corrected sheet feed amount by accumulatively adding the first number and the second number of drive pulses;

wherein the drive-controller operates the sheet feeding mechanism based on the third number of drive pulses to feed the sheet.

15. The sheet feeding device according to claim 1, wherein the printing execution is carried out as a test printing.

16. A sheet feeding device comprising a sheet feeding mechanism having a feed motor for feeding sheets and a drive-controller for drive-controlling the feed motor of the sheet feeding mechanism, the sheet feeding device further comprising:

a correction table which stores correction error levels obtained by dividing a sheet feed error generated in a sheet feed into plural levels and correction factors set in correspondence with each of the correction error levels, which are used for correcting the sheet feed error of the sheet feeding mechanism;

calculating means for calculating an amount of correction to a predetermined sheet feed amount by adding the predetermined sheet feed amount to an amount calculated by multiplying a correction factor corresponding to a correction error level in the correction table to the predetermined sheet feed amount; and correcting means for correcting the sheet feed amount in the sheet feeding mechanism based on the calculated amount of correction.

17. A correction method for a sheet feed amount in a sheet feeding device comprising a sheet feeding mechanism having a feed motor and a drive-controller for drive-controlling the feed motor of the sheet feeding mechanism, the correction method comprising the steps of:

storing a plurality of correction values corresponding to various sheet feed amounts in a correction value storage memory, the correction values for drive pulses applied to the feed motor in correspondence with various sheet feed amounts based on a number of drive pulses;

selecting a correction value which minimizes the sheet feed error of the sheet feeding mechanism from among the correction values stored in the correction value storage memory, based upon an observation of a printed pattern as a result of a previous printing execution; and correcting the sheet feed amount in the sheet feeding mechanism based on the selected correction value.

18. A correction method of sheet feed amount according to claim 17, wherein the storage step is to store a plurality of correction value columns including correction values corresponding to each of different sheet feeding amounts, and the selection step is to select a correction value column which minimizes the sheet feed error of the sheet feeding mechanism from among the correction value columns, and the correction step is to correct the sheet feed amount in the sheet feeding mechanism based on a correction value in the selected correction value column.

19. The sheet feeding device according to claim 17, wherein the printing execution is carried out as a test printing.

* * * * *